US005095433A

United States Patent [19]

Botarelli et al.

[11] Patent Number: 5,095,433

[45] Date of Patent: Mar. 10, 1992

[54] TARGET REPORTING SYSTEM

[75] Inventors: Vincent Botarelli, Evergreen, Colo.; Richard G. Cease, Concord, Mass.; Gary L. Vaughn, Albuquerque, N. Mex.; Ronald L. Roush, Colorado Springs, Colo.

[73] Assignee: Coyote Manufacturing, Inc., Idaho Springs, Colo.

[21] Appl. No.: 561,181

[22] Filed: Aug. 1, 1990

[51] Int. Cl.[5] ..... G06F 15/20

[52] U.S. Cl. ..... 364/423; 235/400; 273/372

[58] Field of Search ..... 364/423; 273/372; 235/400

[56] References Cited

U.S. PATENT DOCUMENTS

| | | | |
|---|---|---|---|
| Re. 32,123 | 4/1986 | Knight | 235/400 |
| 2,939,706 | 6/1960 | Skaredoff | 273/372 |
| 3,022,076 | 2/1962 | Zito | 273/372 |
| 3,323,800 | 6/1967 | Knight | 273/372 |
| 3,489,413 | 1/1970 | Groder et al. | 273/372 |
| 3,678,495 | 7/1972 | Gilbert | 273/372 |
| 4,048,726 | 9/1977 | LeFebvre | 33/180 |
| 4,129,299 | 12/1978 | Busch | 273/372 |
| 4,222,564 | 9/1980 | Allen et al. | 273/369 |
| 4,261,579 | 4/1981 | Bowyer et al. | 273/372 |
| 4,281,241 | 7/1981 | Knight et al. | 235/400 |
| 4,303,853 | 12/1981 | Thalmann | 235/400 |
| 4,307,292 | 12/1981 | Knight et al. | 235/400 |
| 4,349,728 | 4/1982 | Phillips et al. | 364/423 |
| 4,350,881 | 9/1982 | Knight et al. | 235/400 |
| 4,350,882 | 9/1982 | Phillips | 235/400 |
| 4,351,026 | 9/1982 | Phillips | 364/423 |
| 4,357,531 | 11/1982 | Knight | 235/400 |
| 4,361,330 | 11/1982 | Scharer | 273/372 |
| 4,425,500 | 1/1984 | Knight et al. | 235/400 |
| 4,514,621 | 4/1985 | Knight et al. | 235/400 |

*Primary Examiner*—Salvatore Cangialosi
*Attorney, Agent, or Firm*—Lahive & Cockfield

[57] ABSTRACT

A target reporting system utilizes a flexible target sheet having a target image thereon. Preferably, the sheet is positioned in a substantially planar configuration. A plurality of sensors affixed to the target sheet are arranged for detecting vibrations at selected locations on the sheet.

In response thereto, a processor determines the location of a bullet strike (or other vibration-causing impact). A reporting element converts the calculated location to an absolute or relative position and reports it in a human voice-like signal to the target shooter.

21 Claims, 8 Drawing Sheets

TARGET REPORTING SYSTEM

BACKGROUND OF THE INVENTION

This invention relates to target reporting systems and, more particularly, to automated systems for reporting the location impacts, e.g., bullet strikes, on a target.

In the past, a number of schemes for automated target reporting have been proposed. One typical arrangement, disclosed in U.S. Pat. No. 4,349,728, calls for the detection of airborne shock or pressure waves in a chamber as a bullet passes into it. Other prior art systems rely on the detection of vibrations in a rigid target material. For example, U.S. Pat. No. 3,678,495, proposes a target scoring system in which the approximate distance of an impact from a predetermined reference point on a reusable steel target plate is determined by measuring the maximum time difference between arrivals of an acoustic wave at a plurality of measurement points located evenly around that reference point.

A problem with such prior art systems has been the expense and difficulty of using them. The weight and complexity of some constructions, for example, make them difficult to transport, while the relative insensitivity of others result in only crude measurements of the location. Among the system which rely upon reusable targets, on the other hand, repeated bullet impacts may lead to target image degradation.

In view of these and other deficiencies in the prior art designs, an object of this invention is to provide an improved target reporting system.

More particularly, an object of the invention is to provide a target reporting system which is readily transportable, inexpensive to construct, and which accurately reports impact locations, and provides voice response.

A further object of the invention is to provide a target reporting system capable of utilizing disposable target images to prevent image degradation and to permit the target shooter to use a variety of target patterns.

SUMMARY OF THE INVENTION

The aforementioned and other objects are obtained by the invention which provides, in one aspect, a target reporting system utilizing a flexible, target sheet having a target image thereon. Preferably, the sheet is positioned in a substantially planar configuration. A plurality of sensors arranged for detecting vibrations at selected locations on the sheet provide output signals to a microprocessor that triangulates the location of a bullet strike (or other vibration-causing impact). A reporting element converts the calculated location to an absolute or relative position and reports it in a human voice-like signal to the target shooter.

According to another aspect of the invention, the target sheet is fabricated from a spunbonded olefin web and includes a vibration-propagating anisotropy oriented along a first axis. Vibration sensors used in conjunction with the sheet are arranged along a line in the plane of the sheet, preferably, along a line which is angularly offset from that axis. In a related aspect, these sensors comprise three piezoelectric cells adhesively affixed to the target sheet.

These and other aspects of the invention are evident in the attached drawings and in the description which follows.

BRIEF DESCRIPTION OF THE DRAWINGS

A fuller understanding of the invention may be attained by reference to the drawings, in which.

DETAILED DESCRIPTION OF THE ILLUSTRATED EMBODIMENT

Figure 1:
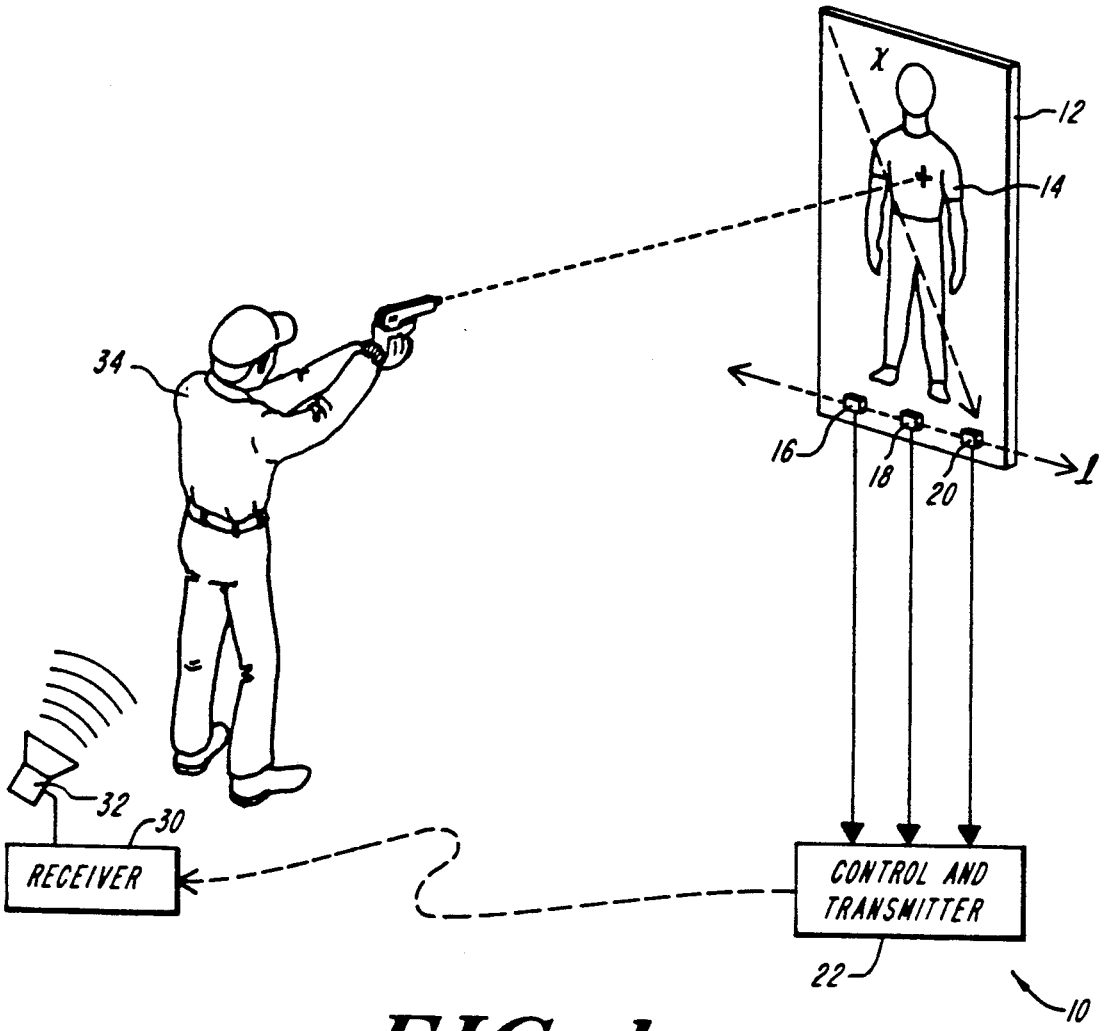
FIG. 1 depicts a target reporting system constructed in accord with a preferred practice of the invention.

FIG. 1 depicts a target reporting system 10 constructed in accord with a preferred practice of the invention. The system 10 includes a planar target sheet 12 bearing a target image 14 and an array of acoustic sensors 16, 18, 20 is affixed to the surface of the target sheet 12. A control-and-transmitter unit 22 is coupled to the sensors 16, 18, 20 for identifying the location of an impact, e.g., a bullet strike, on the target sheet and transmitting a voice signal indicating that location over the airways to a remote receiver 30. The receiver output, routed through speaker 32, provides that voice report to target shooter 34.

In operation, when a bullet from the target shooter 34 hits the target sheet 12, the sensors 16, 18, 20 detect the resulting acoustic vibrations in the sheet 12, passing their output to the control-and-transmitter unit 22. Using a triangulation method, that unit 22 generates a hit signal representative of the location of the bullet strike point in relative form (e.g., "6 inches from the center"), in absolute form (e.g., by coordinates), or by position on the image 14 (e.g., "arm,""leg," etc.). The location signal is reported to the shooter via receiver 30 and speaker 32, the latter of which is preferably embodied in an earphone or headphone.

The impact of the bullet on the target sheet 12 causes an acoustic wave to propagate on the surface at sheet 12 radially away from the impact point. Sensors 16, 18, 20 each include a piezoelectric sensor, positioned on the surface of sheet 12, which is responsive to the leading edge of the acoustic wave. The sensors each provide a voltage signal representative of the amplitude of the incident wave. These voltage signals are applied to associated comparators in front-end circuitry of a microprocessor in unit 22. Bias networks maintain the output of the comparator at a low level until a voltage signal of sufficient strength is received from the sensors 16, 18, 20, at which time the comparator outputs go to a high level. These output transitions at the comparators each clock a separate flip-flop to independently record the "arrival" of the vibration signal from the corresponding sensor 16, 18, 20.

The outputs of each of the flip-flops are used to stop a counter and, thereby, record the time-of-arrival of the vibration. The output of the first flip-flop to change state starts all three counters being clocked by the microprocessor clock, while that flip-flop's changing state "stops" its counter before any clocking can occur, and therefore determines a relative time, t=0, for the other counters. As another sensor input arrives, it triggers its associated flip-flop, stopping its counter. When the last sensor signal arrives, the last counter is stopped, and a signal denoting DONE is passed to microprocessor. Following the generation of the DONE signal, the respective flip-flops are gated to be non-responsive to subsequent signals from the compactors for a time sufficient to permit completion of the impact location determination.

The control-and-transmitter unit 22 microprocessor, upon detecting DONE, reads the three counters: one of them defining the time t=0 and the others defining the relative time of arrival of the vibrations in ¼ microsecond increments. This counter data is divided by four and rounded to yield the arrival times in microseconds. Since the target sheet 12 web material is not uniform, value-dependent data adjustments are made to compensate for the "grain" of that web.

The arrival data is subsequently converted to length, using a conversion factor determined for the web material. Using the differences in distance of the impact to the sensors, the intersection of two hyperbolas is solved by the microprocessor. This gives the location of the impact in X,Y coordinates, which is used to look-up the "zone" of the impact, and to produce an associated voice phrase, which is passed, one word at a time, to a voice-synthesizer. An audio frequency signal generated by the synthesizer is routed to the modulation input of a 49 MHz RF transmitter. The transmitted signal is detected by receiver 30, which generates an audible output to the target shooter 34.

Referring to structure shown in FIG. 1 in greater detail, the target sheet 12 is a flexible, substantially planar sheet material, preferably constructed from a spunbonded olefin web. A preferred such web, comprising substantially randomly directed, interbonded high-density polyethylene microfibers, is commercially under the tradename TYVEK from DuPont Company. A preferred style of TYVEK is 1058D, although other currently manufactured styles of that web product may be beneficially employed in conjunction with target reporting system 10 constructed in accord with the invention.

The aforementioned web material is understood to be anisotropic with respect to the propagation of acoustic waves or vibration. With particular respect to the preferred TYVEK spunbonded olefin web, this anisotropy is understood to run along illustrated x-axis diagonal to the "machine direction" of the web, i.e., the direction in which the web is spun and rolled during manufacture. In the illustration, the anisotropic axis x is disposed at an angle with respect to the bottom edge of the sheet 12. According to a preferred practice of the invention, such an orientation is obtained by cutting a roll of TYVEK web perpendicular to the side edges of that roll. Those side edges correspond to the top and bottom edges of the embodiment shown in FIG. 1.

The target sheet 12 is preferably mounted in a cardboard target holder, which prevents projectiles from excessively ripping the target material, and which provides a mounting hole at the bottom for an antenna of the control-and-transmitter unit 22.

According to a preferred practice, target reporting system 10 employs three identical piezo-electric sensors 16, 18, 20 for detecting vibration resulting from the impact of projectiles, e.g., bullets, on the target sheet 12. Preferably, these sensors are LDT 1-028K piezo-electric cells manufactured by the Pennwalt Corporation, but may be any like detector capable of detecting acoustic waves travelling in target sheet 12 and adaptable for operation in accord with the teaching presented herein.

Piezo-electric sensors 16, 18, 20 are preferably affixed to sheet 12 with double sided tape. A preferred such tape is Y9415 manufactured by 3M. This tape adheres more strongly to the target surface 12 than to the impact sensors 16, 18, 20, facilitating attachment and removal of the sensors from the sheet 12. Because they are employed to sense force, either side of the sensors 16, 18, 20 may be attached to the target, yielding the same polarity of impact signal. It will be appreciated that other means may be employed to affix the sensors 16, 18, 20 to the sheet 12; Preferably, such means will provide ready affixation and attachment as described above.

According to a preferred practice of the invention, only three sensors 16, 18, 20 are employed. These sensors, as shown in FIG. 1, are positioned on illustrated line 1 disposed near the bottom edge of the sheet 12. In a preferred embodiment employing a 25 inch×34 inch target sheet 12, the line 1 lies along the bottom of the sheet 12, with sensor 18 being substantially centered between the sides of the sheet 12 and sensors 16, 20 being positioned approximately ⅛ inches from respective sides of that sheet. The line 1 is angularly offset from the anisotropic axis x, preferably within an angular range of between 15° and 60° and, more preferably, at an angle of 36°, with respect to that anisotropic axis x.

The sensors 16, 18, 20 are preferably connected via three quick-disconnect jacks to the control-and-transmitter unit 22. The jacks can be arranged to hang downwardly to discourage moisture from entering the unit 22. To simplify attachment, the jacks are arranged on the unit 22 housing in the same order that the sensors 16, 18, 20 are arranged across the bottom of the target sheet 12. As indicated above, the unit 22 can be suspended by its radio antenna from the target holder, thereby holding the target stable in a light wind, while keeping the unit itself out of the line-of-fire.

Figure 1A:
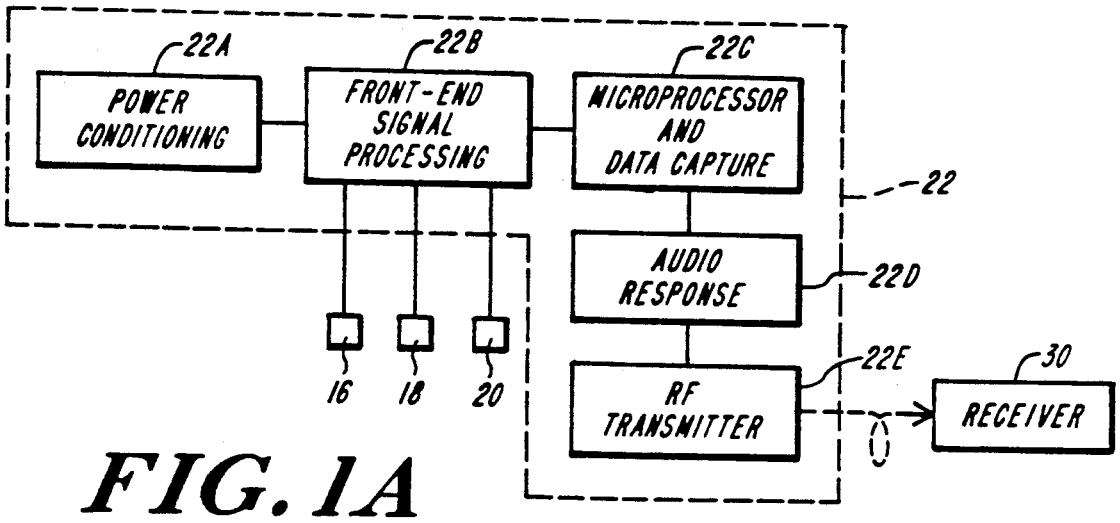
FIG. 1A is a block diagram depicting the overall structure of a preferred control-and-transmitter used to practice the invention.

FIG. 1A is a block diagram depicting the overall structure of the control-and-transmitter unit 22, as well as the relationship between that unit, sensors 16, 18, 20, and receiver 30. The following sections describe the structure of a preferred control-and-transmitter unit 22 and a preferred receiver 30 in detail.

I. Control-and-Transmitter Unit 22

The circuitry comprising the control-and-transmitter unit 22 is presented in five functional sections: the power conditioning network 22A, the front-end signal conditioning network 22B, the microprocessor and data capture network 22C, the audio response network 22D, and the RF transmitter network 22E. It will be understood that the illustrated circuitry represents a preferred embodiment of the invention.

1. The Power Conditioning Network 22A

Figure 2:
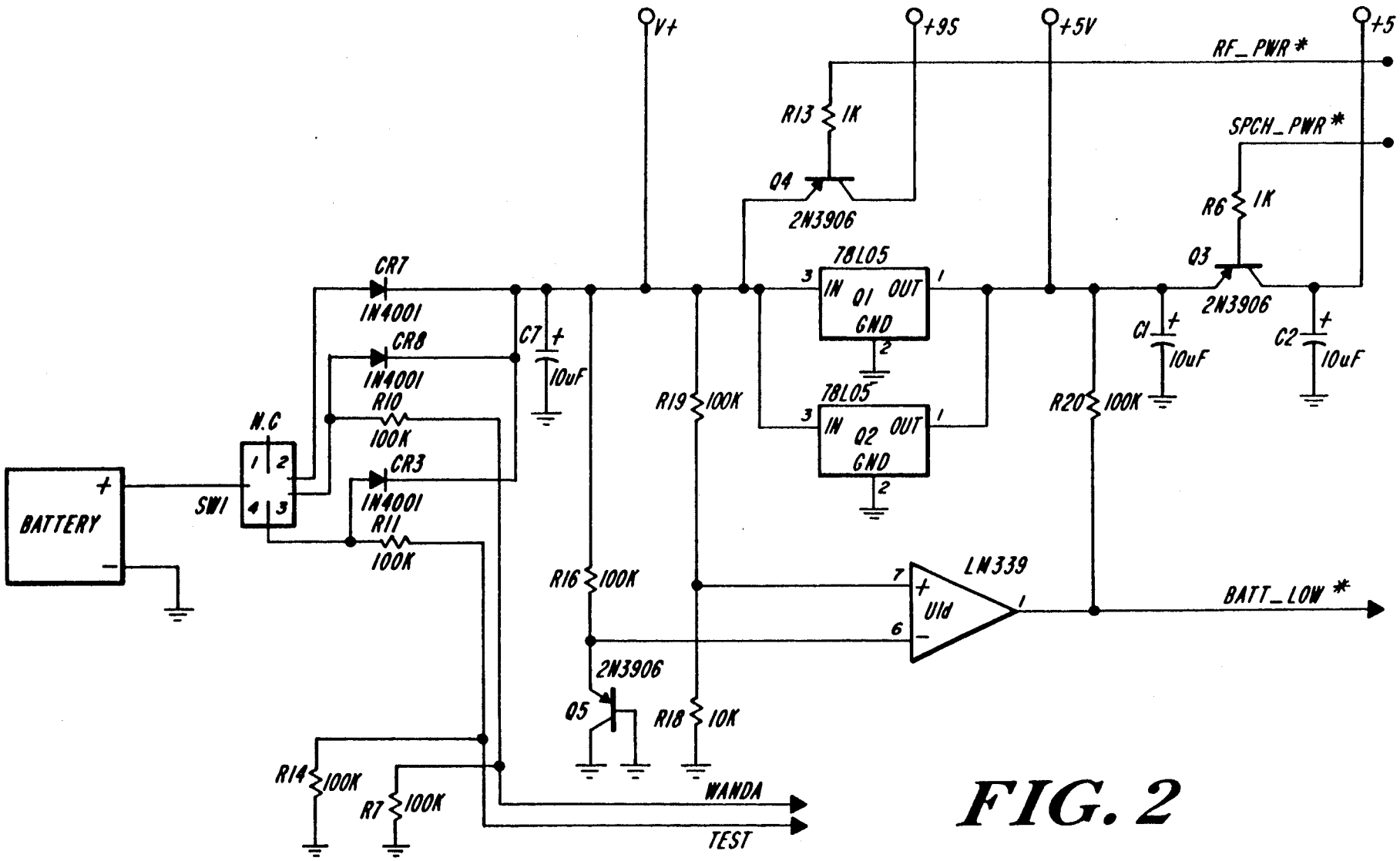
FIG. 2 is a schematic of power conditioning circuitry of a preferred control-and-transmitter unit used to practice the invention.

FIG. 2 is a schematic of preferred power conditioning circuitry of a preferred control-and-transmitter unit 22 (FIG. 1) used to practice the invention. The illustrated circuitry includes, as a power source, a single 9-volt battery of the conventional commercially available type. Power conditioning is provided by switch SW1 and protection diodes CR7, CR8, CR9, two (manufacturer) 78LO5 low-power +5 volt regulators Q1, Q2, low-battery comparator U1*d*, 9-volt transistor switch 4, and +5 volt transistor switch Q3.

Power switch SW1 is preferably part of a rotary-type switch which serves as a voice selection switch permitting the operator (e.g., target shooter 34) to choose between output voice signal formats (e.g., a male or a female voice). Diodes CR7, CR8, CR9 protect the illustrated power conditioning circuitry from inadvertent touches of the battery terminals with reverse polarity as may occur, for example, if the operator changes the battery while the power switch SW1 is in an "on" position. As those skilled in the art will appreciate, the diodes CR7, CR8, CR9 effectively reduce the voltage available to the circuitry from 9 volts, as provided by a fresh battery, to 8.3 volts or less. A capacitor C7 connected to diodes CR7, CR8 and CR9, as illustrated, removes ripple noise-generated in other circuitry sections from the V+ line used to power the front-end comparator and RF transmitter.

The two illustrated 78LO5 +5 volt regulators Q1, Q2 provide the microprocessor U9 (FIG. 4) and audio circuitry with the 5-volt power. Using two such regulators, rather than merely one, provides the necessary current to the other illustrated circuits. The output of regulators Q1, Q2 is bypassed via capacitor C1 to remove ripple.

Illustrated low battery comparator U1*d* is implemented as the fourth gate of a (manufacturer) LM339 quad-comparator; use of the other three gates are discussed below in conjunction with FIG. 3. The comparator U1d's inverting input is held to a reference value of 0.7 volts by a divider formed of resistor R16 and transistor Q5, wired as a diode. Those skilled in the art will appreciate that the transistor Q5 provides desired 0.7 reference voltage, while resistor R16, provides and limits the current from the V+ liner.

Figure 4:
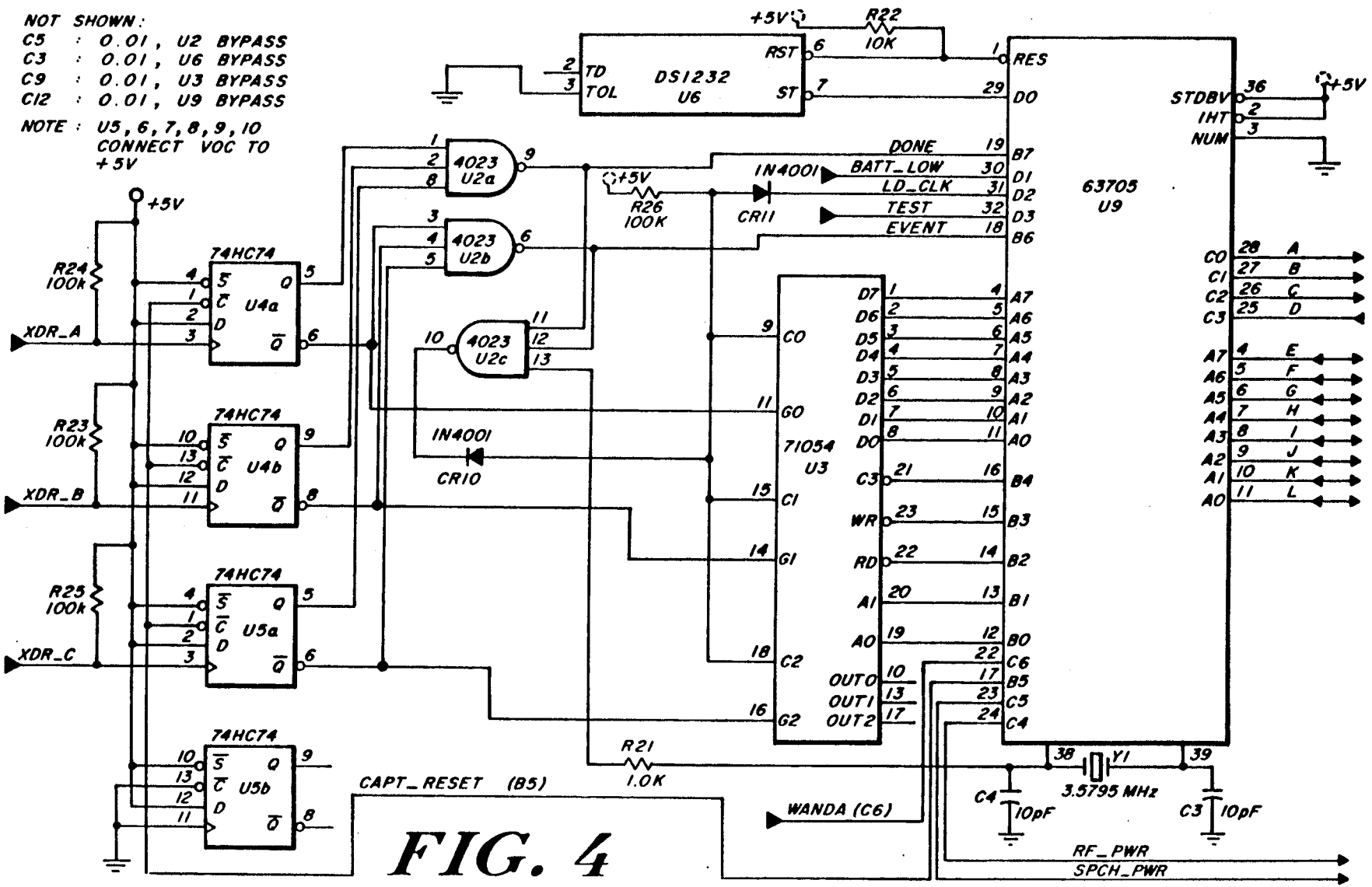
FIG. 4 is a schematic of microprocessor and data capture circuitry of a preferred control-and-transmitter unit used to practice the invention.

The comparator U1d's non-inverting input divides the V+ voltage to nearly 0.7 volts for measurement by resistors R18 and R19. The divider triggers the comparator U1*d* when the battery voltage drops below 0.7 volts. The comparator U1*d* output drives a BATT* signal to the microprocessor U9 (FIG. 4). This output is pulled-up by resistor R20, so that the microprocessor can read the BATT* bit and issue a "LOW BATTERY" output phrase to the operator.

To avoid emissions from on/off switching of the RF transmitter circuitry, and excessive static in the transmitter off state, the microprocessor U9 (FIG. 4) is preferably programmed to leave the RF transmitter circuitry power on all times. In the illustration, circuitry comprising transistor Q4 and resistor R13 is shown as an alternative means for effecting switching should it be desired.

The circuitry illustrated in FIG. 2 further includes transistor Q3, resistor R6, and capacitor C2 which form microprocessor-controlled switch allowing the PROM U10 (FIG. 5) and its corresponding data latch U8 (FIG. 5) to be powered off when not in use. By turning this "switch" on only while actual voice generation is taking place 50% of the power consumed by the PROM U10 and latch U8 is saved. Those skilled in the art will appreciate that element Q3 serves as a transistor switch, that resistor R6 serves to unload the microprocessor I/O bit, and that capacitor C2 serves to de-glitch the voice Power.

2. The Front-End Signal

Conditioning Network 22B

Figure 3A:
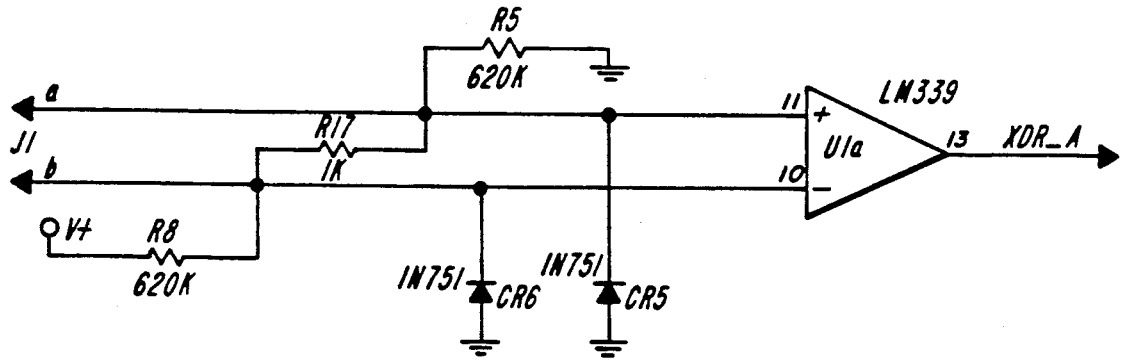
FIGS. 3*a*–3*c* are schematics of front-end signal conditioning circuitry of a preferred control-and-transmitter unit used to practice the invention.
Figure 3B:
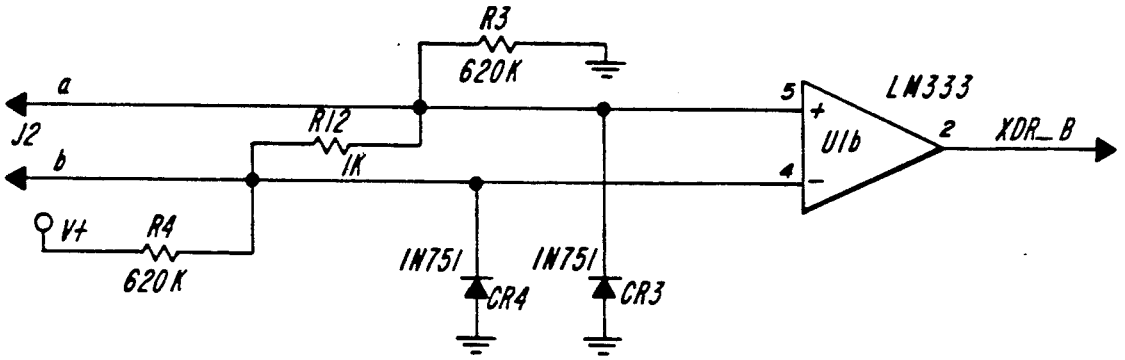
Figure 3C:
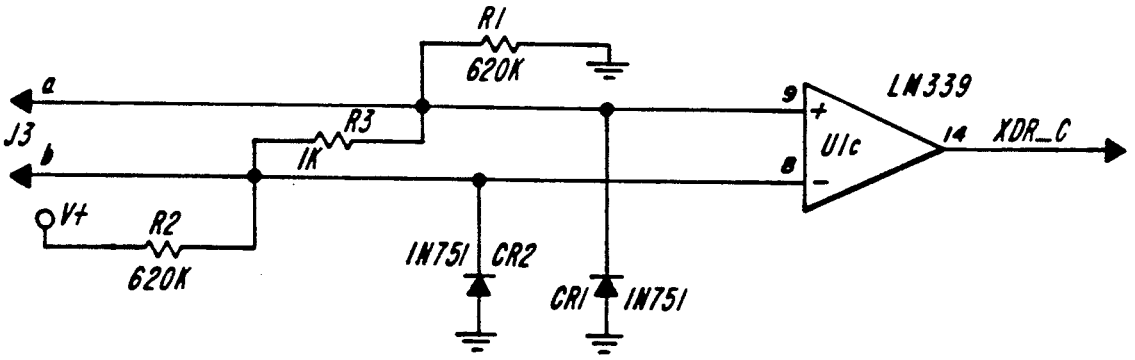

FIGS. 3A-3C are schematics for preferred front-end signal conditioning circuitry of a control-and-transmitter unit 22 used to practice the invention. As detailed below, front-end signal conditioning for each of the sensors 16, 18, 20, (referred to below as channels 1, 2 and 3) is provided by a three resistor divider biasing network, two protection diodes, and a comparator to sharpen the signal edge and clock the channel state flip-flop.

The divider biasing network includes the three resistors (R8, R17, and R5 for channel 1; R4, R12 and R3 for channel 2; and R2, R9 and R1 for channel 3) that provide a low input impedance for reducing noise on the corresponding sensor connecting wires and that bias the comparator's "off" signal with a 10 millivolt threshold. Those skilled in the art will appreciate that since the sensors 16, 18, 20 are current devices, it is difficult, if not impossible, to scope these points.

The protection diodes (CR6 and CR5 for channel 1; CR4 and CR3 for channel 2; and CR2 and CR1 for channel 3) prevent negative spikes from causing spurious outputs in the comparators U1*a*, U1*b*, U1*c*. As those skilled in the art will appreciate, positive spikes are not considered a problem; hence only two diodes are employed in each channel.

The sensor 16, 18, 20 outputs can be connected directly to the inverting and non-inverting inputs of the corresponding comparators U1*a*, U1*b*, U1*c*. In a preferred embodiment of the invention, however, a high-pass filter of the type shown in FIG. 9 is coupled between each of the sensors and the corresponding comparator.

Figure 9:
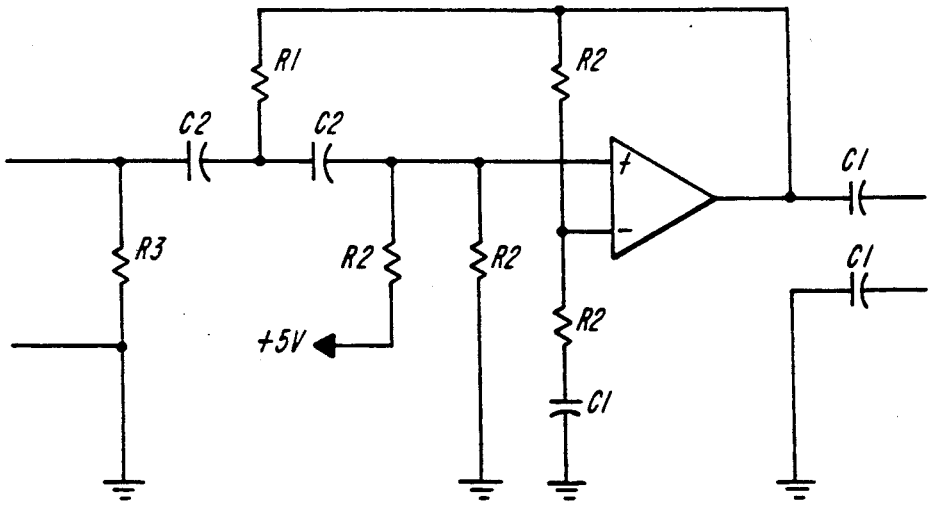
FIG. 9 is a schematic of high-pass filter circuitry for conditioning sensor signals of a preferred control-and-transmitter unit used to practice the invention.

Referring to FIG. 9, the illustrated circuit filters unwanted components, e.g., noise, from a sensor signal generated when a projectile travelling at or near the speed of sound impacts the target sheet 12. The filter includes resistors R-1, R-2 and R-3; capacitors C-1 and C-2; and an invertor connected in the illustrated manner. Preferably, resistors R-1 are 10 K ohms, R-2 are 15 K ohms and R-3 are 1.4K ohms; while capacitor C-1 is preferably 0.47 microfarads.

To accommodate the grain of the target sheet 12 material, the value of capacitor C-2 preferably varies depending upon the sensor 16, 18, 20 to which the filter is attached. Particularly, C-2 is preferably 1000 picofarads for the leftmost illustrated sensor 16; 470 picofarads for the center illustrated sensor 18; and 680 picofarads for the right sensor 20.

Referring, again, to FIGS. 3A-3C, each comparator U1*a*, U1*b*, U1*c* serves to "square up" the sensor output signal, removing the rise-time of the wave shape. Since the comparators U1*a*, U1*b*, U1*c* can only draw current, i.e. drive a "low" signal output, a pull-up resistor (R23, R24, R25 of FIG. 4) is used to return the comparator U1*a*, U1*b*, U1*c* output to high quickly. Particularly, once the comparator inverting input goes below the noninverting input, the output is pulled "high". As those skilled in the art will appreciate, an upper limit on the value of the pull-up is governed by the rise-time of a 15 KHz input signal and the input capacitance of the flops U4*a*, U4*b*, U5*a* (FIG. 4).

Particularly, with respect to the illustrated circuit:

$$F = \frac{1}{2\pi RC}$$

$$R = \frac{1}{2\pi FC} \approx \frac{1}{2 \times 3.14 \times 15000 \times 3.5 \times 10^{-12}}$$

$$R \approx 3\text{M ohms}$$

Hence, illustrated resistors R23, R24, R25, each rated at 100 K ohms, are very conservative and, yet, do not load the battery power.

Preferably, the three comparators U1*a*, U1*b*, U1*c* illustrated in FIG. 3 reside on a single LM339 quad-comparator IC to ensure similar operating points for all three channels. These comparators are powered directly from the 9-volt battery and their outputs are passed to the state flip-flop circuitry discussed below.

3. The Microprocessor and Data Control Network 22C

FIG. 4 is a schematic of microprocessor and data capture circuitry of a preferred control-and-transmitter unit used to practice the invention. As shown in the drawing, the microprocessor and data capture circuitry includes channel state flip-flops U4*a*, U4*b*, U5*a* to latch the time of arrival event; three event gates U2*a*, U2*b*, U2*c* to detect event start (i.e. any one of the channel flip-flop going low), event done (i.e. all of the channel flip-flops going low), and the counter clock gate (to parallel clock all the counters during the event start to event done interval); the front-end counter U3 containing three parallel counters, clocked by the microprocessor clock and gated by the channel state flip-flops, to record the relative time of arrivals; the microprocessor U9; and the watchdog U6.

In a preferred embodiment, two (manufacturer) 74HC74 dual flip-flop ICs are used to provide the illustrated three state flip-flops U4*a*, U4*b*, U5*a*, U5*b*. The "D" inputs of all of the flip-flops are tied high, as are the unused SET inputs. The CLR inputs are driven by the multiprocessor U9, via the signal $CAPT_{13}$ RESET. The three clock inputs are driven low by the corresponding comparators U1*a*, U1*b*, U1*c* (FIG. 2) and are pulled-up by resistors R23, R24, and R25, as illustrated. The aforementioned 74HC74 IC dual flip-flops show a typical clock-to-Q,Q* propagation time of 14 nanoseconds, with a worst case of 44 nanoseconds. The upper two channels, i.e., flip-flops U4*a*, U4*b*, are in the same IC, so their propagation delays are nearly identical and therefore self-cancelling. However, the third channel, flip-flop U5*a*, is in a separate IC, and may be up to 29 nanoseconds different. Because this 29 nanoseconds is within one count of the jitter sources described above and should not be of concern. The 74HC74 IC used for flip-flops U4*a*, U4*b*, U5*a* is CMOS and, therefore, is bypassed with a 0.01 μfd capacitor (not shown) to keep the +Vcc line noise free.

In another preferred embodiment, the Fairchild 74AC74 IC, with triple 3-Input NAND functions, is used in place of the 74HC74 IC. Here, the worst-case propagation delays are reduced from 1 nanoseconds to 10 nanoseconds; hence a worst-case variation of only 10 nanoseconds between the IC's. Use of this IC eliminates the part-to-part variation.

As further illustrated in FIG. 4, three triple-input NAND gates U2*a*, U2*b*, U2*c* are used to generate the DONE*, EVENT and gated clock signals for the (manufacturer) uPD71054 U3 triple counter U8. Resistor R26, diode CR11, and diode CR10 serve as an "OR" gate allowing the microprocessor U9 to clock initializing data into the uPD71054 U3 counters, while U2-10 (i.e., illustrated pin 10 of element U2) is holding the gated clock "high". As those skilled in the art will appreciate, the function of resistor R21 in the microprocessor U9 clock line is to unload the microprocessor crystal U9. Because the NAND gates U2*a*, U2*b*, U2*c*, implemented on RCA CD4023 chips, are CMOS and switching at 3.5795 Mhz, they are bypassed with a 0.01 ufd capacitor (not shown) to keep the +5 Vcc plane noise free.

With reference to element U3, the uPD71054 front-end counter starts a cycle with microprocessor U9 resetting all state flip-flops U4*a*, U4*b*, U4*c* to "0" (i.e. all Q*'s high) with a programmed high-low-high on the CAPT RESET* input/output channel. Initially all the channel state flip-flop Q*'s are high and arm the counter gates "on", but no counting occurs because the NAND gate U2*b*, which generates the EVENT signal, holds this signal low until the first channel state flip-flop is clocked by the arrival of the first pulse on any of the channels. EVENT being low causes the downstream NAND gate to block all microprocessor clock Y1 signals from reaching the front-end counters U3 clock inputs.

Once the first input pulse arrives, the corresponding channel's counter state flip-flop U4*a*, U4*b*, U4*c* clocks Q high (and Q* low). The Q* low raises the EVENT signal and allows the microprocessor clock Y1 signal to flow to the counter's clock U3 inputs. However, the channel in question also lowers its counter gate and hence records no data in its counter. The other counters are free to count until their respective input pulses arrive and clock their respective state flip-flops, shutting "off" the gates of the counters.

Meanwhile, each state flip-flop Q "low" combines in the NAND gate U2*a* to set DONE* high. The DONE* signal will remain high until all the channel state flip-flops U4A, U4B, U4C are clocked to the "on" state, and all the Q's are "high". This will cause the downstream NAND gate U2*c* to once again block the microprocessor clock Y1 signals from reaching the counter clock inputs.

Since the time-of-arrival of any of the channel pulses is asynchronous with respect to the microprocessor clock used to measure, or count, the delay, the counter clock pulse stream is turned on within one count of the clock Y1 (while the gates are armed "on") and is gated off within one count of the clock Y1 (while the counters which are running measuring time-of-arrival delays on the other two channels). As those skilled in the art will appreciate, this means that the accuracy of the counter data is within two counts.

The uPD71054 IC U3 maximum clock input frequency is 8 Mhz, well within the range of the applied 3.5795 Mhz microprocessor clock Y1 used to measure time-of-arrival delay. The clock input requirements are also met (clock minimum high of 60 nanoseconds, clock minimum low of 60 nanoseconds, clock minimum transition of 25 nanoseconds) with the microprocessor crystal used in the steady state. However the first and last clocks to the counters may or may not meet the 60 nanoseconds requirement for positive counting.

The uPD71054 gate set-up time, which is 50 nanoseconds to the first clock-high, is met by the two CD4023 NAND gate delays of 120 to 240 nanoseconds (60 to 120 nanoseconds each). However this 120 nanoseconds spread from unit to unit of the CMOS CD4023 chip illuminates another potential source cf inaccuracy, namely the time between the start of the clocking and the gating off of the clocks due to the state flip-flop change. However, those skilled in the art will appreciate that this source of clock jitter is indistinguishable in the 280 nanoseconds period of the microprocessor clock (140 nanoseconds high and 140 nanoseconds low).

The RCA CD4023B NAND gate package has a 125 to 250 nanoseconds propagation delay time, or nearly twice that of the RCA CD4023 parts cited in the above paragraphs. This results in a two gate combined time of 250 to 500 nanoseconds of propagation delay. Since the counter clock is only 280 nanoseconds, the 250 to 500 nanoseconds represents another full clock count of error in accuracy in the event these parts are instead used.

As indicated in FIG. 4, a preferred microprocessor unit U9 for use in practice of the invention is the Hitachi 63705. Other commercially available processors having on-board ROM process control programming, on-board RAM for stack and variables, 31 I/O pins, and CMOS construction for battery operations, may also be suitable for practice of the invention. The microprocessor timing signals are generated by a 3.5795 MHz oscillator Y1, bypassed to ground with capacitors C3 and C4 to reduce transmitted noise. Because the microprocessor is a large CMOS IC, it is preferably bypassed with both a 10 μfd and a 0.1 μfd capacitor (not shown) to de-glitch the +Vcc power line.

Figure 5:
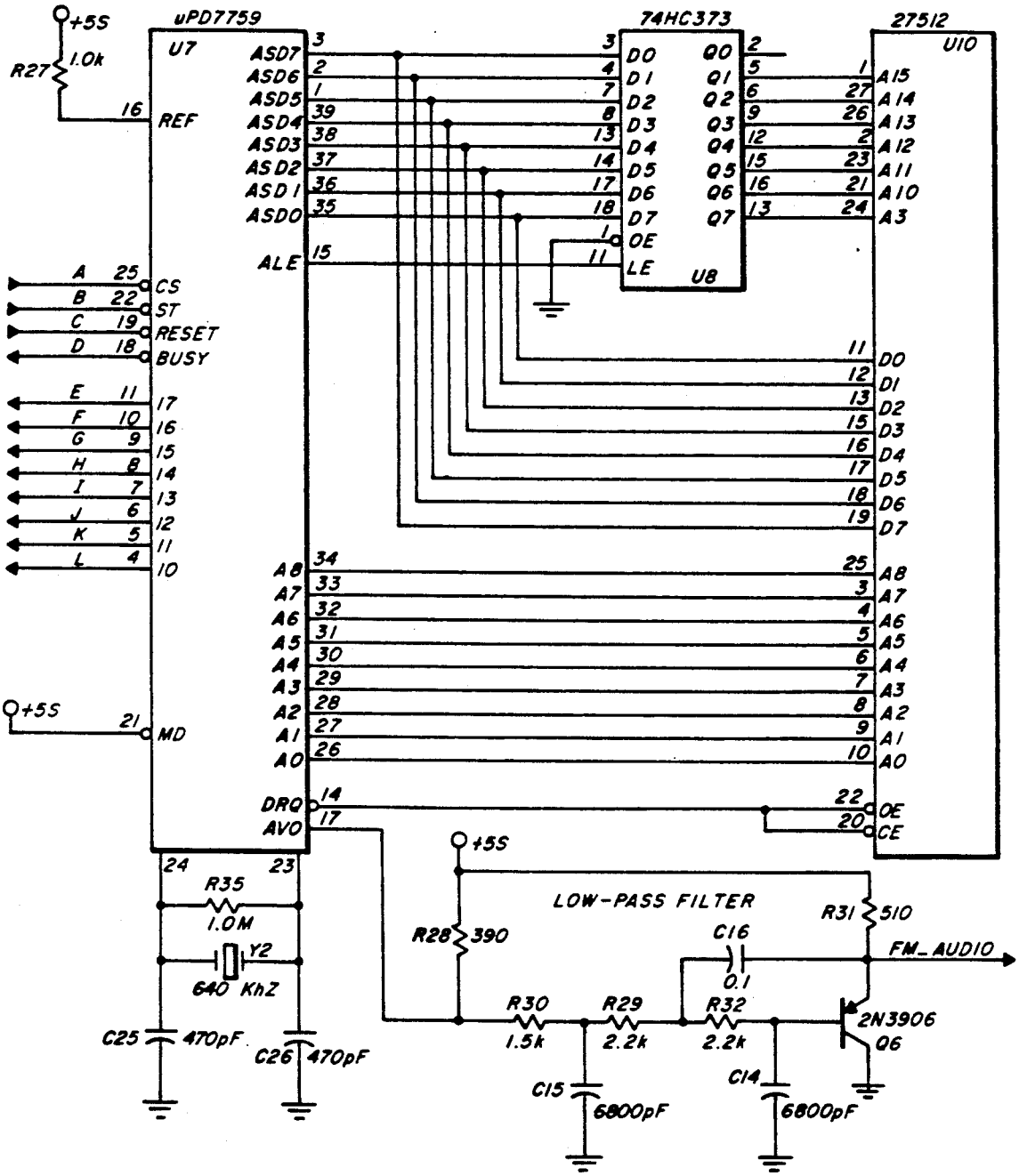
FIG. 5 is a schematic of voice generation circuitry of a preferred control-and-transmitter unit used to practice the invention.

The microprocessor I/O is arranged around the microprocessor IC with 23 of the 31 available I/O pins dedicated as follows:

1) EVENT (Port B, bit 6) active high input signal: an event is underway and the time delay counters are counting;
2) DONE* (port B, bit 7) active low input signal: an event has concluded and all counters are ready to be read;
3) $BATT_{13}LOW$* (port D, bit 1) active low input signal: 9-volt battery is too weak for reliable operation;
4) D0–D7: (port A) 8-Data I/O pins used for both the counter read-out and voice-synthesizer control;
5) FEC_CS*: (port B, bit 4) front-end counter active-low chip select, causing the DO-D7 pins to be used to read (and write) the 71054 counter IC U8;
6) FEC_WR*: (port B, bit 3) front-end counter write strobe; an microprocessor active-low output pin causing the microprocessor D0–D7 pins to be used to write data to the 71054 counter IC U8;
7) FEC_RD*: (port B, bit 2) front-end counter read select; an microprocessor active-low output pin causing the microprocessor D0–D7 pins to be used to read data from the 71054 counter IC U8;
8) FEC_A1, FEC_A0: (port B, bit 1 and bit 0) front-end counter internal register address lines; two microprocessor active-high output pins selecting a single register within the 71054 counter IC U8 to be targeted for read/write operations;
9) CAPT_RESET*: (port B, bit 5) front-end flip-flop reset; an microprocessor active-low output pin causing the three state flip-flops of the three input channels to be reset in preparation for the next data acquisition cycle;
10) WANDA: (Port C, bit 6) voice style selection input; an microprocessor input selecting which of two "voices" the response is to be used;
11) RF_PWR*: (Port C, bit 4) active-low output causing the 9-volt RF transmitter Vcc line shut off and conserve battery power. Final software does not use this control, RF power is always on;
12) SPCH_PWR*: (Port C, bit 5) active-low output causing the 5-volt voice synthesizer Vcc line to shut off and conserve battery power;
13) VS_CS*: (port C, bit 0) voice Synthesizer chip select; an microprocessor active-low output pin causing the D0–D7 pins to be used to read (and write) the 7759 voice-synthesizer IC (FIG. 5, element U7). This pin is denoted "A" for schematic shorthand;
14) VS_BUSY*: (port C, bit 3) voice Synthesizer active-low busy signal; an microprocessor input pin allowing the microprocessor to sense the current voice message completion to continue the message text, or shut down the voice-synthesizer and RF transmitter (to conserve battery power). This pin is denoted "D" for schematic shorthand;
15) VS_ST: (port C, bit 1) voice synthesizer start signal; an microprocessor active-low output pin causing the 7759 voice synthesizer IC to generate the selected message. This pin is denoted as "B" for schematic shorthand;
16) VS_RESET*: (port C, bit 2) voice synthesizer reset signal; an microprocessor active-low output pin causing the 7759 voice synthesizer IC to curtail voice generation and reset. This pin is denoted as "C" for schematic shorthand.

Object code for controlling a microprocessor used in a preferred practice of the invention is listed in Appendix A, filed herewith.

In a preferred embodiment, illustrated embodiment, a Dallas Semiconductor watch-dog timer DS1232 U6 is used to detect stalling of the microprocessor by use of a software toggled I/O pin. If the watch-dog U6 times out, the microprocessor is "reset" and recovers via its power-up routines to a ready state. In a preferred embodiment, the DS1232 U6 will reset the microprocessor if the voltage to it (and the microprocessor) drops below 4.75 volts (pin 3 grounded), or 600 milliseconds (with pin 2 floating) since the microprocessor has last stimulated the ST* input (pin 7) of the DS1232 via the I/O pin being cycled by microprocessor software. The DS1232 +Vcc (pin B) is bypassed to ground with C6 (0.01 ufd capacitor) to eliminate very fast negative voltage spikes (i.e. power line noise) from causing false resets. Illustrated resistor R22 is necessary because the output RST is an open-collector.

4. The Audio Response Network 22D

FIG. 5 is a schematic of voice generation circuitry of a preferred control-and-transmitter unit used to practice the invention. Referring to the drawing, the illustrated system generates audio response generation as a synthetic voice whose pattern is stored in a PROM and whose output modulates the FM transmitter for broadcasting. The audio generation comprises the uPD7759 speech synthesizer manufactured by NEC, the 74HC373 phrase address latch manufactured by RCA, the voice pattern 27512 PROM manufactured by TOSHIBA, and the 5-kHz audio filter on the output.

At speech generation time, the microprocessor U9 (FIG. 4) turns on the power to the audio section and initializes it. Because the synthesizer U7 is on a data bus, particularly, microprocessor port A, its power must remain on all the time, so that the microprocessor U9 can access the uPD71054 U7 counters, also on microprocessor port A.

The synthesizer U7, upon command from the microprocessor U9, latches the phrase address into illustrated 74HC373 latch U8. This latch drives the upper address lines of the PROM to select the beginning of a phrase in memory. Then the synthesizer U7 counts through the lower address lines of the PROM to supply itself with the data stream necessary to generate the phrase. In a preferred embodiment of the invention, phrases are generated in accord with the position of the bullet strike relative to the center of the target. These phrases include, for example, the expressions "LEFT," "LEFT AND HIGH," "LEFT AND WAY HIGH," "WAY RIGHT AND WAY LOW," etc.

The speech output is passed through a 5-kHz low-pass audio filter, shown at the bottom of FIG. 5, to remove unwanted high frequency components, such as switching noise, from the signal, which is used to modulate the FM transmitter. During speech generation, the microprocessor U9 monitors the BUSY* signal from the synthesizer U7 to determine when the phrase is finished, and shuts off the power to the audio section to conserve battery energy.

5. The RF Transmitter Network 22E

Figure 6:
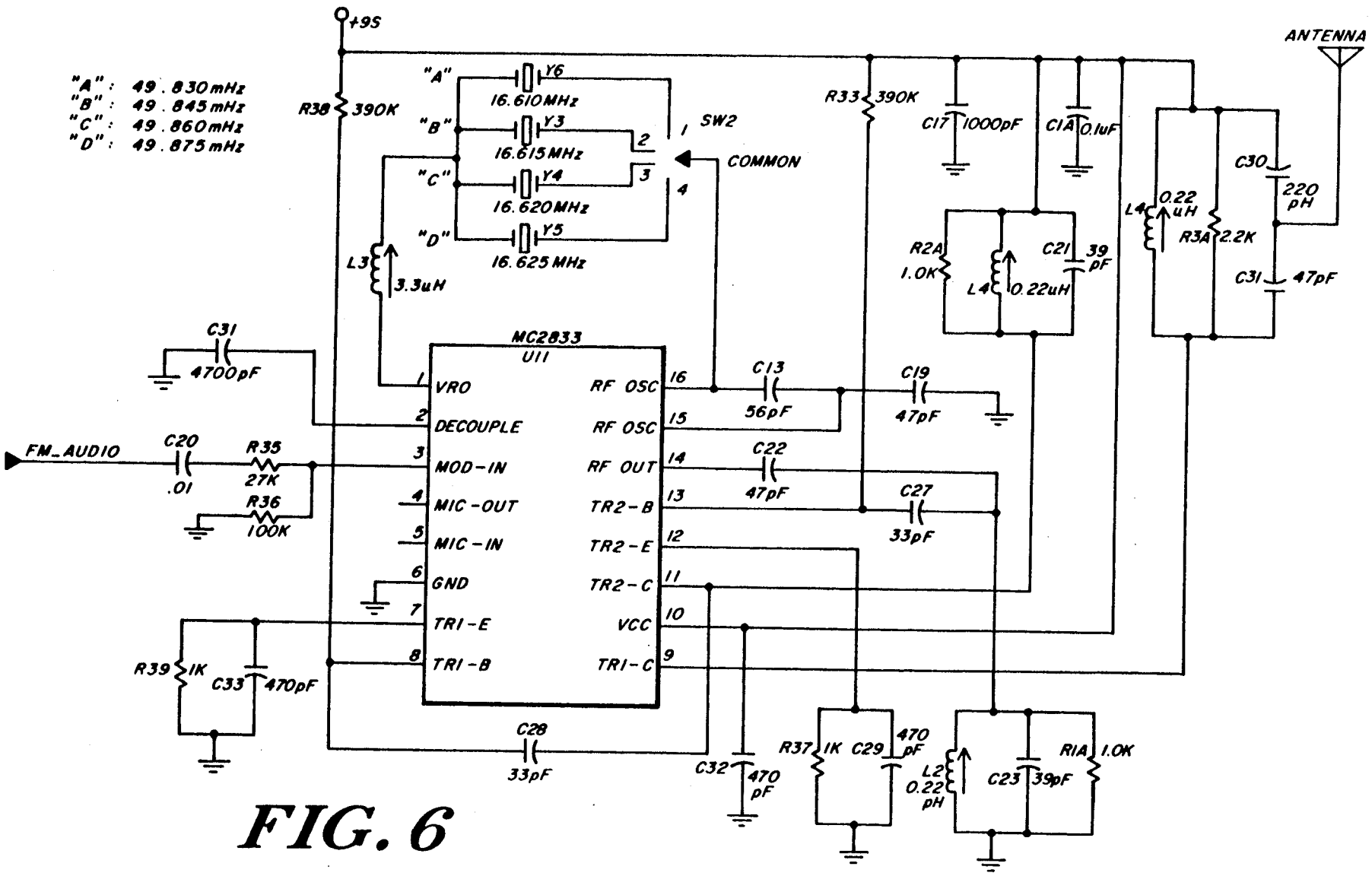
FIG. 6 is a schematic of RF transmitter circuitry of a preferred control-and-transmitter unit used to practice the invention.

FIG. 6 illustrates preferred circuitry for a RF transmitter used in conjunction with practice of the invention. The transmitter is a 4-channel crystal-controlled FM transmitter operating in the 49 MHz region. The four channels, as specified by the FCC, are: Channel A: 49.830 MHz; Channel B: 49.845 MHz; Channel C: 49.860 MHz; and Channel D: 49.875 MHz. As discussed above, the 9-volt power to the transmitter is controlled by the microprocessor and is left "ON" at all times to quiet the receiver and to allow it to maintain a lock on the carrier. Components of the FM transmitter include the MC2833 Low Power FM Transmitter System IC U11; the four crystals and selection switch SW2, and the antenna.

According to a preferred practice, the four crystals Y3, Y4, Y5, Y6, operating at one-third the frequency of the final RF output, are used because the transmitter U11 contains a frequency tripler. Inductor L3 is coupled to the crystals Y3, Y4, Y5, Y6 to get them oscillating.

The RF-OUT (pin 14) of transmitter U11 is AC coupled to capacitor C22 and a tank circuit, including inductor L2 and capacitor C23, is adjusted to block the 49 MHz region. The R1A output of transmitter U11 reduces gain and parasitic feedback caused by the current layout, while the 49 MHz RF output is coupled through capacitor C27 into the base of Tr-2 (pin 13). Resistor R33 provides biasing for this transistor base, and the emitter of Tr-2 (pin 12) is bypassed to ground via R37–C29. The collector output of Tr-2 (pin 11) is biased via tank circuit L4-C21, with R2A again used to reduce gain and parasitic feedback caused by the current layout. Tr-2 (Pin 11) is also AC-coupled into the base of Tr-1 (pin 8) through capacitor C28.

In further accord with the illustration, Tr-1 base is also biased via resistor R38. The Tr-1 emitter (pin 7) is also bypassed to ground via tank circuit R39–C33, the same as Tr-2. The collector Tr-1 (pin 9) is used to drive the antenna via the tank L4-C31,C30. Again, R3A is used to reduce gain and parasitic feedback caused by the current layout.

The audio input is AC coupled through capacitor C20 and reduced by the divider of resistors R35 and R36 to prevent over modulating the FM. Capacitor C31 is a decoupling capacitor required by the MC2833 IC.

II. The Receiver 30

Figure 7:
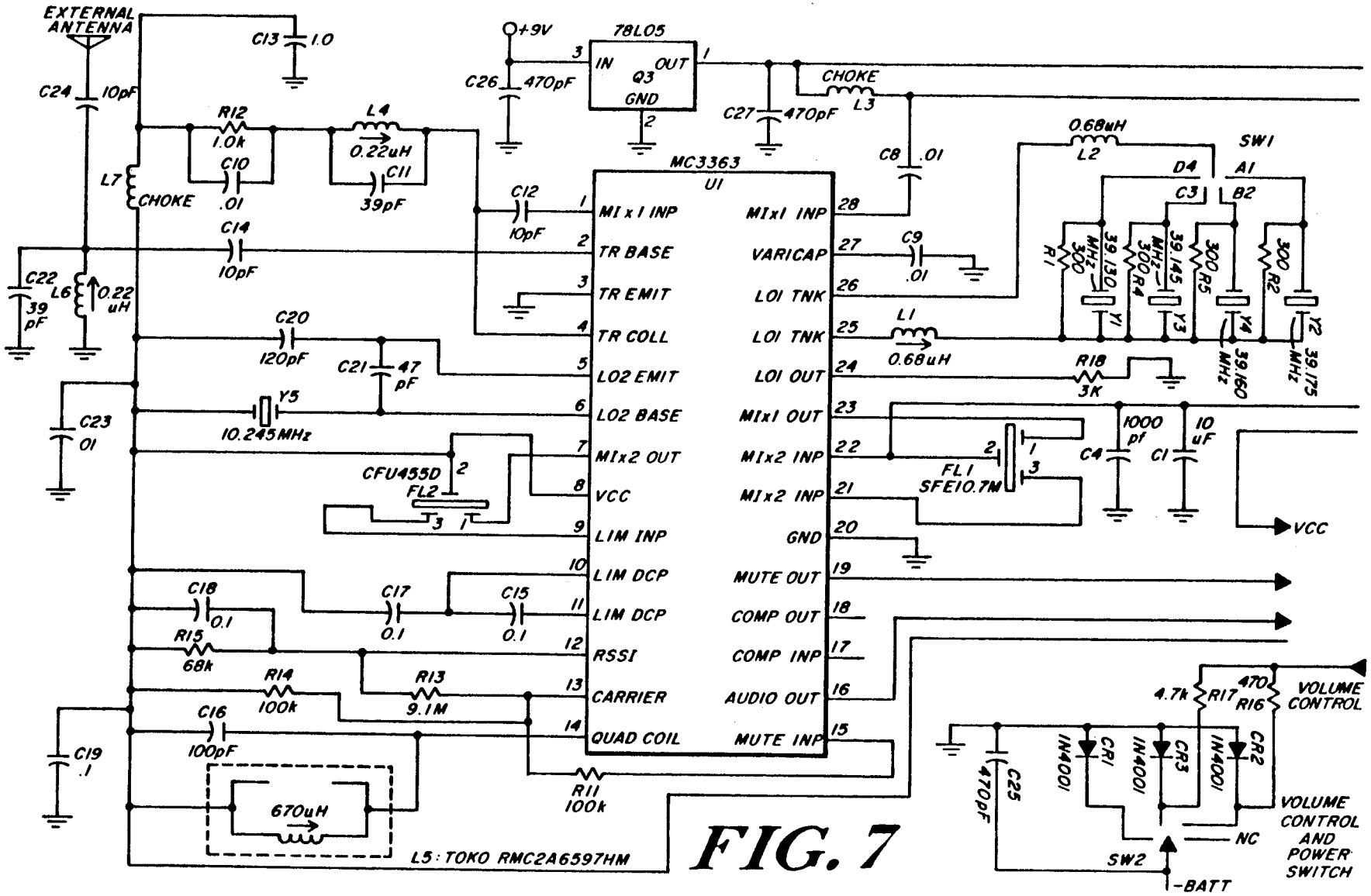
FIGS. 7–8 are schematics of receiver circuitry used in conjunction with a preferred target reporting system used to practice the invention.
Figure 8:
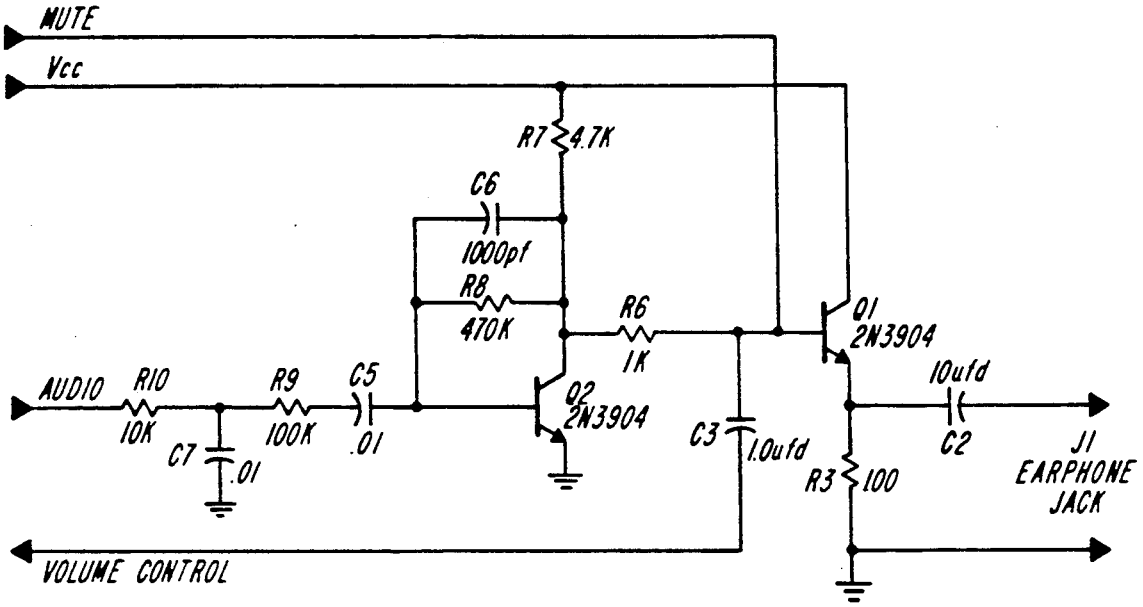

The target report system receiver circuitry 30, illustrated in FIGS. 7 and 8, is of conventional design. As illustrated, the antenna input is coupled through capacitor C24 to parallel tank circuit of L5–C22. This tank blocks 49 MHz from being shorted to ground and passes through capacitor C14 into the base of the RF amplifier transistor "Tr" (pin 2). The emitter of Tr is grounded, while the collector of "Tr" is biased from +5 volts via tank R12–C10, and the parallel tank circuit L4–C11. This tank circuit blocks only 49 MHz, which is then coupled through C12 into the first IF mixer input (pin 1). Illustrated inductor L7 serves as a choke used to isolate the +5 volt from the rest of the circuit. Capacitor C13 is a bypass to ground for this plane.

The illustrated mixer input of pin 28 is not used in this design and is tied off to +5 volt through C8. The Varicap input is also not used; and is tied off to ground via C9. These two connections are specified in the data sheet and application notes for the MC3363. The only other mixer input is the local oscillator "LO1" circuit (pin 25 and 26) comprised of L1, L2, and one of the four 39 MHz crystals (paralleled by a 300 ohm resistor). L01 Out (pin 24) is grounded through R18 to permit scoping and L1 adjustment. Hence, the primary mixer output is the difference between the RF and the L0 frequency. The 1st IF is 10.7 MHz:

| Channel | RF | LO | IF |
|---|---|---|---|
| "A" | 49.830 | 39.130 = | 10.7 |
| "B" | 49.845 | 39.145 = | 10.7 |
| "C" | 49.860 | 39.160 = | 10.7 |
| "D" | 49.875 | 39.175 = | 10.7 |

The 1st mixer output (pin 23) is fed through the ceramic filter FL1 (SFE10.7) to filter out all but the 10.7 MHz signal. The base of the 10.7 filter is tied to +5 volts, bypassed by C4 to ground, and connected to Mixer 2 Input (pin 22). Illustrated choke L3 is used to isolate the +5 from the rest of the circuit. C1 is a bypass to ground for this plane.

The output of the 10.7 filter is fed into the input of the 2nd IF mixer: Mix2 (pin 21). Internally, local oscillator L02 is an input to the mixer as well. L02 is excited by the 10.245 MHz crystal, Y5, at pins 5 and 6. C20 and C21 are to sustain the oscillation. The output of mixer 2 is:

$$10.7-10.245=0.455\ldots455\text{ KHz}$$

The output of mixer 2 (Pin 7) is Passed through the 455 KHz ceramic filter FL2 (CFU455D). The base of FL2 is tied to +5 volts, and the output goes to the limiter input "Lim Inp" (pin 9).

With respect to squelch, capacitors C17 and C15 are the necessary limiter decoupling capacitors. R15 controls the "squelch" level, in concert with R13, R14, and C18. The Carrier Detect signal is passed through R11 to the mute comparator input. This signal is used to block the audio at the earphone if insufficient carrier signal is present.

Regarding audio detection, the MC2833 requires L5-C16 tank (pin 14) to decode the FM in the limiter into audio and pass it out the Audio Out (pin 16).

The audio output of the MC2833 (pin 16) is filtered by R10-C7-R9, and AC coupled through capacitor C5 into the base of transistor Q2. Capacitor C6 and resistor R8 provide the transistor Q2 base biasing from the transistor Q2 collector. Transistor Q2 collector is tied to +5 volts through resistor R7. The collector output of transistor Q2 is passed through resistor R6 and forms an AC voltage divider through capacitor C3 to either resistor R16 and R17, or open depending on switch SW2's position. At the base of transistor Q1, the Mute output (pin 19) may float and allow audio to pass, or clamp low and suppress all audio (squelched). Transistor Q1 forms an emitter follower (unity voltage gain, but much current gain) to impedance match the high impedance of the collector circuit of transistor Q2 to the low impedance of the earphone. Resistor R3 forms the load for the emitter follower, and the earphone is AC coupled through capacitor C2.

Switch SW2 is used to both select the audio level, and act as an off/on switch. This implementation requires breaking the ground connection to the 9-volt battery, and use diodes CR1, CR2, and CR3 to prevent reversing the voltage of the unit, and to separate the audio voltage divider resistors. Illustrated capacitor C25 bypasses switch SW2 for RF noise.

The "+" lead of the 9-volt battery is passed through the 5-volt regulator Q3. Q3 is also bypassed on both sides by C25 and C27. The 49 MHz RF section is isolated by the choke L7, the 39 MHz Local Oscillator is isolated by the choke L3, and the 10.245 oscillator is isolated by a PC cut in the power plane to be fed directly from the regulator Q3. Capacitors C23, C19, and C1 form a recommended IC bypass.

Described above is an improved target reporting system meeting the aforementioned objects. The system utilizes a flexible target sheet which can have a target image imprinted thereon and which is preferably positioned in a substantially planar configuration. A plurality of sensors arranged along the bottom of the sheet detect vibrations resulting from an impact, e.g., as caused by a bullet strike, on the sheet. A microprocessor triangulates the location of the impact from signals generated by the sensors. That location can be converted to an absolute or relative position and reported to the target shooter in a human-like voice.

A system constructed in accord with the invention is readily transportable, inexpensive to construct, and reports accurate impact locations. Because its sensors may be readily attached and removed from target sheets, the system also achieves the desired capability to use disposable target images.

Those skilled in the art will appreciate that the embodiments described above are exemplary, and that other embodiments incorporating additions, deletions or other modifications also fall within the scope of this invention.

What we claim is:

1. A. target reporting system comprising

A. a flexible target sheet, wherein said target sheet comprises a non-woven web of substantially randomly directed, interbonded microfibers, B. a plurality of sensor means affixed to said sheet, each for detecting vibration at an associated location on said target sheet and for generating a signal representative thereof, C. processor means connected with said sensor means for determining from the vibration-representative signals generated by said plurality of sensor means a location of a vibration-causing impact on said target sheet and for generating a signal representative of that location, and D. means coupled with said processing means for reporting said location-representative signal.

2. A target reporting system according to claim 1 wherein said target sheet comprises a non-woven web of substantially randomly directed, interbonded microfibers.

3. A target reporting system according to claim 2 wherein said microfibers comprise polyethylene.

4. A target reporting system according to claim 3 wherein said microfibers comprise high density polyethylene.

5. A target reporting system according to claim 1 wherein said sensor means comprise piezoelectric sensors.

6. A target reporting system according to claim 1 wherein said reporting means includes means for generating a voice signal indicative of said location-representative signal.

7. A target reporting system according to claim 6 wherein said reporting means includes means transmitter means for transmitting said location-representative signal to a remote location.

8. A target reporting system according to claim 1 wherein said target sheet bears a target image.

9. A target reporting system according to claim 1 wherein said processor means includes a plurality of flip-flop means, each coupled with an associated one of said sensor means, for clocking the generation of said vibration-representative signal thereby.

10. A target reporting system according to claim 9 wherein

A. said flip-flop means are arranged so that a flip-flop means associated with a first of said sensor means to detect vibrations associated with a vibration-causing impact clocks a reference time and said flip-flop means associated with said other sensor means clock difference times and B. said processor means includes means for determining said location from said reference and difference times.

11. A target reporting system including

A. a flexible, substantially planar target sheet having a vibration-propagating anisotropy oriented along a first axis, B. sensor means for detecting vibration at three discrete points along a line disposed on the plane of said target sheet, said sensor means comprising piezoelectric cells adhesively affixed to said target sheet along said line, said line being angularly offset with respect to said first axis, C. processor means connected with said sensor means for determining from the vibration-representative signals generated by said plurality of sensor means a location of a vibration-causing impact on said target sheet and for generating a signal representative of that location, and D. means coupled with said processing means for reporting said location-representative signal, said reporting means includes means for generating a voice signal indicative of said location-representative signal and further including transmitter means for transmitting said location-representative signal to a remote location.

12. A target reporting system comprising

A. a flexible target sheet, wherein said target sheet has a vibration-propagating anisotropy oriented along a first axis.

B. a plurality of sensor means affixed to said sheet, each for detecting vibration at an associated location on said target sheet and for generating a signal representative thereof, C. processor means connected with said sensor means for determining from the vibration-representative signals generated by said plurality of sensor means a location of a vibration-causing impact on said target sheet and for generating a signal representative of that location, and D. means coupled with said processing means for reporting said location-representative signal.

13. A target reporting system according to claim 12 wherein said plurality of sensor means are arranged for detecting vibration at discrete points substantially along a line in the plane of said target sheet.

14. A target reporting system according to claim 13 wherein said line is angularly offset with respect to said first axis.

15. A target reporting system according to claim 14 wherein said plurality of sensor means are arranged for detecting vibration at three discrete points along said line.

16. A target reporting system according to claim 12 wherein said sensor means comprise piezoelectric sensors.

17. A target reporting system according to claim 12 wherein said reporting means includes means for generating a voice signal indicative of said location-representative signal.

18. A target reporting system according to claim 17 wherein said reporting means includes means transmitter means for transmitting said location-representative signal to a remote location.

19. A target reporting system according to claim 12 wherein said target sheet bears a target image.

20. A target reporting system according to claim 12 wherein said processor means includes a plurality of flip-flop means, each coupled with an associated one of said sensor means, for clocking the generation of said vibration-representative signal thereby.

21. A target reporting system according to claim 20 wherein:

A. said flip-flop means are arranged so that a flip-flop means associated with a first of said sensor means to detect vibrations associated with a vibration-causing impact clocks a reference time and said flip-flop means associated with said other sensor means clock difference times and B. said processor means includes means for determining said location from said reference and difference times.

* * * * *